US010381136B2

(12) United States Patent
Grant

(10) Patent No.: US 10,381,136 B2
(45) Date of Patent: Aug. 13, 2019

(54) SIGNAL TRANSMISSION CABLE

(71) Applicant: Luxshare Precision Industry Co., Ltd, Shenzhen (CN)

(72) Inventor: Charles Grant, Shenzhen (CN)

(73) Assignee: LUXSHARE PRECISION INDUSTRY CO., LTD, Baoan District, Shenzhen (CN)

( * ) Notice: Subject to any disclaimer, the term of this patent is extended or adjusted under 35 U.S.C. 154(b) by 0 days.

(21) Appl. No.: 16/044,976

(22) Filed: Jul. 25, 2018

(65) Prior Publication Data

US 2019/0221332 A1 Jul. 18, 2019

(30) Foreign Application Priority Data

Jan. 16, 2018 (CN) ..... 2018 2 0063702 U

(51) Int. Cl.
*H01B 11/18* (2006.01)
*H01B 11/10* (2006.01)

(52) U.S. Cl.
CPC ..... *H01B 11/1817* (2013.01); *H01B 11/1066* (2013.01)

(58) Field of Classification Search
CPC .. H01B 7/0208; H01B 7/0216; H01B 7/0225; H01B 7/0807; H01B 11/1066
See application file for complete search history.

(56) References Cited

U.S. PATENT DOCUMENTS 4,327,246 A * 4/1982 Kincaid ..... H01B 11/1025 174/105 R
2012/0267159 A1* 10/2012 Gundel ..... H01B 7/0838 174/350

* cited by examiner

*Primary Examiner* — Hoa C Nguyen
*Assistant Examiner* — Amol H Patel
(74) *Attorney, Agent, or Firm* — Woodard, Emhardt, Henry, Reeves & Wagner, LLP

(57) ABSTRACT

Provided is a signal transmission cable. The signal transmission cable includes: at least one pair of signal wires for transmitting a group of differential electronic signals, a first metal shielding film coated on a part of a surface of the at least one pair of signal wires; a second metal shielding film opposite to the first metal shielding film and coated on a part of a surface of the at least one pair of signal wires; and a first insulation film by which the first metal shielding film and the second metal shielding film are secured to the surface of the pair of signal wires. The first metal shielding film and the second metal shielding film are collectively coated on the entire surface of the at least one pair of signal wires, and the second metal shielding film partially overlaps the first metal shielding film.

16 Claims, 9 Drawing Sheets

SIGNAL TRANSMISSION CABLE

CROSS-REFERENCES TO RELATED APPLICATIONS

This application claims priority to Chinese patent application No. 201820063702.8, filed on Jan. 16, 2018, the disclosure of which is incorporated herein by reference in its entirety.

TECHNICAL FIELD

The present disclosure relates to a signal transmission cable, and in particular to a signal transmission cable with a metal shielding film.

BACKGROUND

Two devices transmit signals to each other through a cable disposed between these devices. However, in recent years, since the transmission amount of the signals increases substantially, high-frequency signals are used in the signal transmission. Moreover, two adjacent wires in the cable are quite close, so the transmission of the high-frequency signal is susceptible to an interference problem, producing a cross-talk phenomenon on the high-frequency signal, causing errors in the signal transmission and reducing the quality of transmission.

In order to solve the interference problem generated by the high-frequency signal, the wire for transmitting information coated with a metal shielding structure is designed to solve the high-frequency interference problem. The shielding structure may be fixed to the wire in many ways. When the shielding components coated on the exterior of the wires are fixed in a spiral longitudinal winding manner, gaps are easily formed between the shielding components or the shielding components have different thicknesses across the surface of the wire, which can easily affect the wire and cause inconsistent impedances, resulting in a an increase in insertion loss, and thus reducing the efficiency of signal transmission.

In existing art, with reference to FIG. 9, U.S. Pat. No. 8,653,373 discloses a shielded cable structure A. The cable structure A includes a pair of wires B, a first shielding tape C and a second shielding tape D. Each wire B includes a core wire B1 and an insulator B2. The core wire B1 is coated by the insulator B2. The first shielding tape C includes a plastic tape C1 and a metal foil C2. The plastic tape C1 and the metal foil C2 are attached to each other. The second shielding tape D includes a plastic tape D1 and a metal foil D2. The plastic tape D1 and the metal foil D2 are attached to each other. These wires B are arranged in parallel. The first shielding tape C is secured to the surfaces of these wires B in a spiral winding manner in a direction in which these wires B extend longitudinally. Adjacent parts of the wound first shielding tape C overlap each other to form an overlap portion C3 and a step portion C4. The second shielding tape D is secured to the surface of the first shielding tape C in a spiral winding manner in the direction in which these wires B extend longitudinally, and the winding direction of the first shielding tape C is different from that of the second shielding tape D. Adjacent parts of the wound second shielding tape D overlap each other to form an overlap portion D3 and a step portion D4. By doubly coating the wires B with the first shielding tape C and the second shielding tape D, a better electromagnetic shielding effect is expected.

However, the outer surfaces of the wires B are coated by the first shielding tape C and the second shielding tape D in a multi-layer manner, the spiral winding manner makes these first shielding tapes to form overlapping structures having different layers, which vary constantly in the direction in which these wires B extend longitudinally. The first shielding tape C and the second shielding tape D form an overlapping structure having three layers and an overlapping structure having four layers on the outer surfaces of these wires which alternate. These overlapping structures easily cause the impedance values of the wires B to vary continuously, resulting in an increase of insertion loss, thereby affecting the quality and efficiency of signal transmission in the wires B.

The spiral winding manner of these shielding tapes disclosed by the related art still has a defect of inconsistent impedances, easily causing a loss in the signal transmission, unable to meet various industrial requirements. In order to maintain the quality of signal transmission in the cable, there is a tremendous need for an improved design for the cable.

SUMMARY

One or more embodiments of the present disclosure provide a signal transmission cable, which in particular has an arrangement in which the wires are enclosed by metal shielding films. Therefore, the interference noise generated between wires is isolated by the metal shielding films, thereby achieving a better quality of signal transmission.

One or more embodiments of the present disclosure provide a signal transmission cable, which in particular uses an insulation film to secure the metal shielding film. Therefore, the wires can be stably surrounded by the metal shielding film, thereby fixing the metal shielding film better.

Embodiments of the present disclosure provide signal transmission cable, which includes: a pair of signal wires for transmitting a group of differential electronic signals; a first metal shielding film coated on a first part of a surface of the pair of signal wires; a second metal shielding film opposite to the first metal shielding film and coated on a second part of the surface of the pair of signal wires; and a first insulation film for securing the first metal shielding film and the second metal shielding film to the surface of the pair of signal wires. The first metal shielding film and the second metal shielding film are collectively coated on the entire surface of the pair of signal wires, and the second metal shielding film partially overlaps the first metal shielding film.

In the embodiments of the present disclosure, the metal shielding films of the signal transmission cable are made of metal foils and coated on the wires oppositely, significantly alleviating a problem of uneven thickness of the metal shielding films in the longitudinal direction of the wires caused by the overlapping of metal shielding films. Moreover, in combination with the design of insulation film, each metal shielding film is secured to the outer surface of the wires to reduce the interference noise on the wires from outside and between the wires, thereby achieving a better electromagnetic shielding effect.

DETAILED DESCRIPTION

Figure 1:
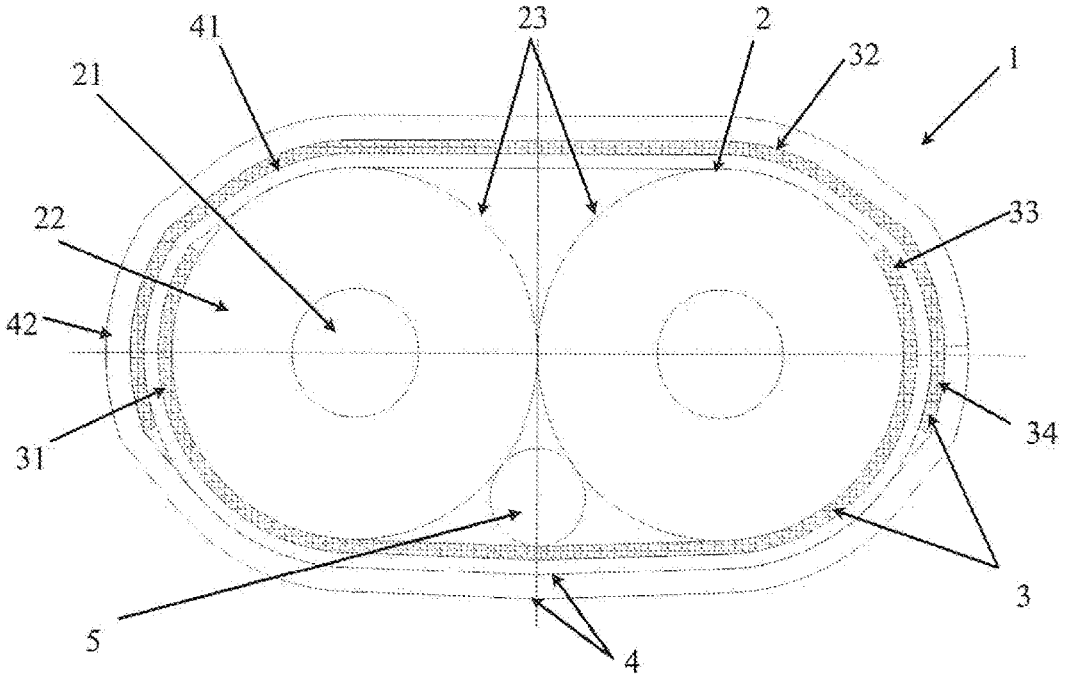
FIG. 1 is a cross-sectional view of a signal transmission cable of a first embodiment of the present disclosure.

With reference to FIG. 1, an embodiment of the present disclosure discloses a signal transmission cable 1. The signal transmission cable 1 includes wires 2, metal shielding films 3, insulation films 4 and at least one grounding wire 5.

As disclosed in a first embodiment of the present disclosure with reference to FIG. 1, these wires 2 are arranged in parallel and adjacent to each other. Each wire 2 includes a conductor 21 and an insulation layer 22 coated on the conductor 21. The conductor 21 is made of metal material. The material for forming the conductor 21 includes a single element of Cu, Al, Sn, Ni, Ag or Au, or an alloy thereof, or a structure which is formed by one of these elements as substrate and another one of the these elements plated on the one element, so as to achieve a better conductive effect. The shape of the conductor 21 is designed to be an elongated cylinder or a twisted structure formed by a plurality of weaved thin metal wires.

The insulation layer 22 is made of non-conductive plastic material, and the insulation layer 22 is coated on an exterior surface of the conductor 21, and the insulation layer 22 and the conductor 21 may have a same axis. The material of the insulation layer 22 includes polyester, e.g., polyvinyl chloride (PVC) or polyethylene (PE), and has a good insulating effect. The insulation layer 22 may be a tape made from polyester, and the tape made from polyester is fixed to the conductor 21 in a spiral winding manner using adhesive. The insulation layer 22 may also be formed on the exterior surface of the conductors 21 by coating to achieve the insulation effect.

As disclosed in the embodiment of the present disclosure, these wires 2 include at least one pair of signal wires 23. When the high-frequency signal is transmitted, the problem of high-frequency interference easily occurs. To solve this problem, the differential electronic signals are transmitted through the pair of signal wires 23 in a differential signal pair manner. The differential signals of the differential signal pair respectively are simultaneously transmitted in the pair of adjacent signal conductors 23. Two signals in the differential signal pair have the same amplitude and are opposite in phase. Due to this characteristic, the interferences to signals transmitted by the pair of adjacent signal conductors 23 may offset with each other, thereby having advantages of strong anti-interference ability, effective suppressing electromagnetic interference (EMI) ability and accurate timing positioning, and greatly improving the quality and efficiency of the signal transmission. As disclosed in the embodiment of the present disclosure, these metal shielding films 3 are thin sheets made from metal material. The metal shielding films 3 are made of one or more of materials consisting of Al, Cu, Pb, Sn, and a laminated film formed by polyester is added, such that these metal shielding films 3 have characteristics of electromagnetic interference isolation and better thermal conduction.

These metal shielding films 3 include a first metal shielding film 31 and a second metal shielding film 32 outside the first metal shielding film 31. Two ends of the first metal shielding film 31 each have a first edge 33. The first metal shielding film 31 covers a part of a surface of the insulation layers 22 of this pair of signal wires 23. A gap between the first edges 33 exposes the other part of the surface of this pair of signal wires 23. The axes of the pair of signal wires 23 are connected to each other to form a horizontal axis line, and two perpendicular axis lines each pass through a respective one of the axes of the pair of signal wires 23 and is perpendicular to the horizontal axis line. The angle between one of the horizontal axis line and the perpendicular axis line and a line, which connects a first edge to the axis of the signal wire adjacent to the first edge, is about 45 degrees.

As disclosed in an embodiment of the present disclosure, the insulation films 4 include a first insulation film 41 and a second insulation film 42. The first insulation film 41 covers the first metal shielding film 31 and a part of the second insulation film 42, such that the first metal shielding film 31 is secured between the pair of signal wires 23 and the second insulation film 42. The first metal shielding film 31 may be secured by gluing or clamping. The second insulation film 42 is attached to the each of the pair of signal wires 23 exposed between the first edges 33, and the first edges 33 of the first metal shielding film 31 is clamped between the second insulation layer 42 and the pair of signal wires 23. The first edge 33 of the first metal shielding film 31 does not exceed contacting points of the second insulation film 42 and the pair of signal wires 23, such that the first metal shielding film 31 can be smoothly secured by the second insulation film 42, thereby preventing the first edge 33 of the first metal shielding film 31 from being warped or sliding.

As disclosed in an embodiment of the present disclosure, the second metal shielding film 32 has second edges 34. There is a gap between the second edges 34. The second metal shielding film 32 is coated on the surface of the second insulation film 42, such that the second metal shielding film 32 is coated on a part of the surface of the pair of signal wires 23 with the second insulation film 42 disposed between the second shielding film 32 and the pair of signal wires 23, and the second metal shielding film 32 is coated on the gap between the first edges 33 between the first metal shielding film 32. The gap between the second edges 34 exposes the second insulation film 42, such that the second insulation film 42 is partially disposed between the first metal shielding film 31 and the second metal shielding film 32. An angle between each of the horizontal axis line and the perpendicular axis lines and a line connecting a terminal of each second edge 34 and the axis of the signal wire adjacent to the each second edge 34 is about 45 degrees. The second edges 34 of the second metal shielding film 32 respectively overlap the first edges 33 of the first metal shielding film 31 with the second insulation layer 42 disposed between the first edges 33 and the second edges 34, such that the periphery of the pair of signal wires 23 are completely enclosed by the first metal shielding film 31 and the second metal shielding film 32. Positions where the first metal shielding film 31 and the second metal shielding film 32 overlap each other are respectively located a surface of an end of one of the pair of signal wires 23 and a surface of an end the other one of the pair of signal wires 23 away from the surfaces of the end of the one of the pair of signal wires 23, and are symmetrical to each other. Positions where the first metal shielding film 31 and the second metal shielding film 32 overlap each other are located at side edges of the pair of signal wires 23 which are symmetrical to each other, such that the generated electromagnetic effects can be mutually balanced. The first metal shielding film 31 and the second metal shielding film 32 are longitudinally arranged in an extending direction of the pair of signal wires 23 and face each other, and then enclose the pair of signal lines oppositely. The pair of signal wires 23 is isolated from outside through the metal shielding films 3, such that the pair of signal wires 23 is enabled to not be interfered by outside signals, thereby achieving a better shielding effect.

As disclosed in an embodiment of the present disclosure, the first insulation film 41 covers the second metal shielding film 32 and the surface of the second insulation layer 42 exposed between the second edges 34. The second metal shielding film 32 is fixed between the first insulation film 41 and the second insulation film 42, and the second insulation film 42 exposed between the second edges 34 is fixed between the first metal shielding film 31 and the first insulation film 41. The fixing may be achieved by gluing or clamping. The second edges 34 of the second metal shielding film 32 are smoothly fitted to surface of the second insulation film 42 by the first insulation film 41 so as to prevent the second edges 34 from being uneven. Each of the first metal shielding film 31 and the second metal shielding film 32 is one or more layers of plastic tape spirally wound to the exterior of the pair of signal wires 23, or one or more layers of plastic extruded and secured to the exterior of the pair of signal wires 23. The first insulation film 41 and the second insulation film 42 are made of a transparent or translucent material so as to facilitate the detection of the status that the inner first metal shielding film 31 and second metal shielding film 32 are coated on the pair of signal wires 23.

In an embodiment of the present disclosure, the ground wire 5 has an elongated cylindrical metal structure. In an embodiment, the ground wire 5 may be a bare twisted metal wire. The ground wire 5 is not coated by any insulation material, and is arranged in the gap between the pair of signal wires 23 in a bare state. The ground wire 5 is in contact with the first metal shielding film 31 and is electrically connected to the first metal shielding film 31. The ground wire 5 is mainly used for absorbing the electromagnetic interference generated by the pair of signal wires 23 and grounding the electromagnetic noise received by the first metal shielding film 31 quickly. Therefore, the ground wire 5 is continuously arranged between the pair of signal wires 23 and has characteristics such as low resistance for achieving the effects of quickly grounding and reducing electromagnetic interference.

Figure 2:
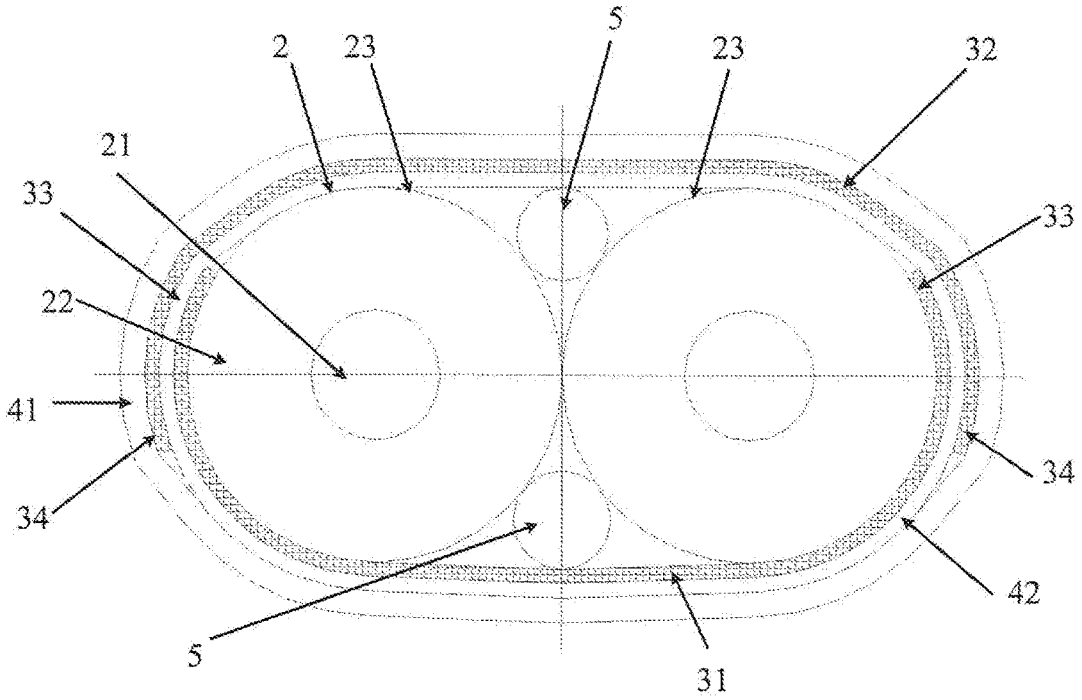
FIG. 2 is a cross-sectional view of a signal transmission cable of a second embodiment of the present disclosure.

In a second embodiment of the present disclosure, with reference to FIG. 2, the most important difference between the second embodiment and the first embodiment lies on the ground wires 5. In the second embodiment, in order to reduce the interference noise generated by outside or the crosstalk between the wires 2 during the signal transmission via the pair of signal wires 23, an additional ground wire 5 is arranged between the pair of signal wires 23 particularly. The two ground wires 5 are symmetrical to each other with respect to the horizontal axis line passing through the axes of the pair of signal wires 23. The arrangement of two ground wires 5 particularly contributes much during the high-frequency signal transmission in reducing an error rate of signal transmission and improving the quality of signal transmission.

Figure 3:
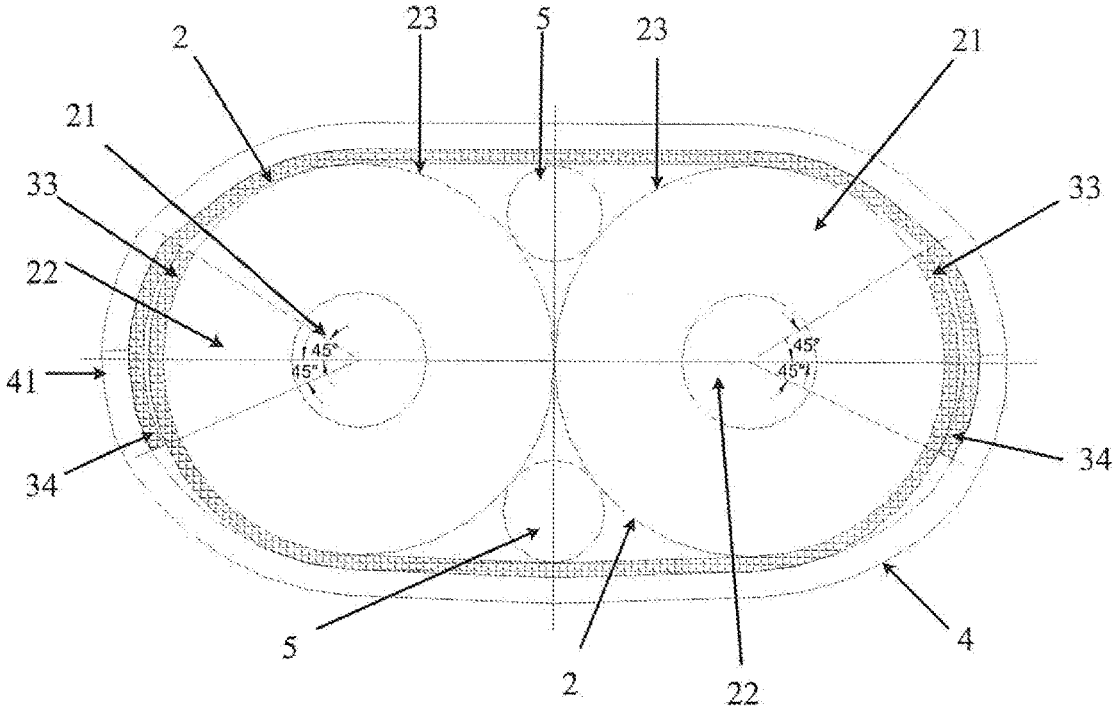
FIG. 3 is a cross-sectional view of a signal transmission cable of a third embodiment of the present disclosure.

In a third embodiment of the present disclosure, with reference to FIG. 3, the most important difference between the second embodiment and the third embodiment lies in that no second insulation film 42 is arranged in the third embodiment. There is a gap between the first edges 33 of the first metal shielding film 31. The first metal shielding film 31 is coated on a part of the surface of the pair of signal wires 23, the remaining part of the surface of the pair of signal wires 23 is exposed between the first edges 33. The second metal shielding film 32 has second edges 34 each overlapping a respective one of the first edges 3, and the second metal shielding film 32 covers the gap between the first edges 33, such that the second metal shielding film 32 is coated on a part of the surface of the pair of signal wires 23. Moreover, the second metal shielding film 32 is in contact with the pair of signal wires 23 exposed between the first edges 33, and the first edges 33 of the first metal shielding film 331 are secured to the surface of the pair of signal wires 23 by the second edges 34 of the second metal shielding film 34 respectively. There is no second insulation film 42 between the first metal shielding film 31 and the second metal shielding film 32 for segregation, so the first metal shielding film 31 is in physical direct contact with the second metal shielding film 32, such that the first metal shielding film 31 and the second metal shielding film 32 are electrically connected to each other. The first insulation film 41 is coated on both of the surface of the first metal shielding film 31 and the surface of the second metal shielding film 32. The first metal shielding film 31 and the second metal shielding film 32 are secured to the surface of the pair of signal wires 23 by the first insulation film 41. The first metal shielding film 31 and the second metal shielding film 32 are bent to each other to enclose an enclosed space. The pair of signal wires 23 is arranged in the enclosed space respectively, and a better electromagnetic shielding effect is obtained through such structure.

An angle between one of the horizontal axis line and the vertical axis lines and a line connecting a terminal of the first edge 33 or the terminal of the second edge 34 and the axis of the signal wire adjacent to the first edge 33 or the second edge 34 is about 45 degrees. The arrangement in which the angle is about 45 degrees has a better fixing effect, such that the first edges 33 of the first metal shielding film 31 are secured to surface of the pair of signal wires 23 by the second metal shielding film 32, and the second edges 34 of the second metal shielding film 32 are secured to surface of the first metal shielding film 31 by the first insulation film 41, thereby preventing the first edges 33 or the second edges 34 from being uneven or warped due to a too long or too short design of the first edges 33 and the second edges 34. The above securing manner may adopt gluing or clamping. The two ground wires 5 are arranged in gaps adjacent to the pair of signal wires 23. The ground wires 5 are symmetrically arranged with respect to the horizontal axis line. The pair of signal wires 23 and the ground wires 5 are arranged inside the space formed by the first metal shielding film 31 and the second metal shielding film 32, and the ground wires 5 are in contact with the metal shielding films 3 respectively, such that the metal shielding films 3 are electrically connected to the ground wires 5 so as to provide a better electromagnetic shielding characteristic for the pair of signal wires 23.

Figure 4:
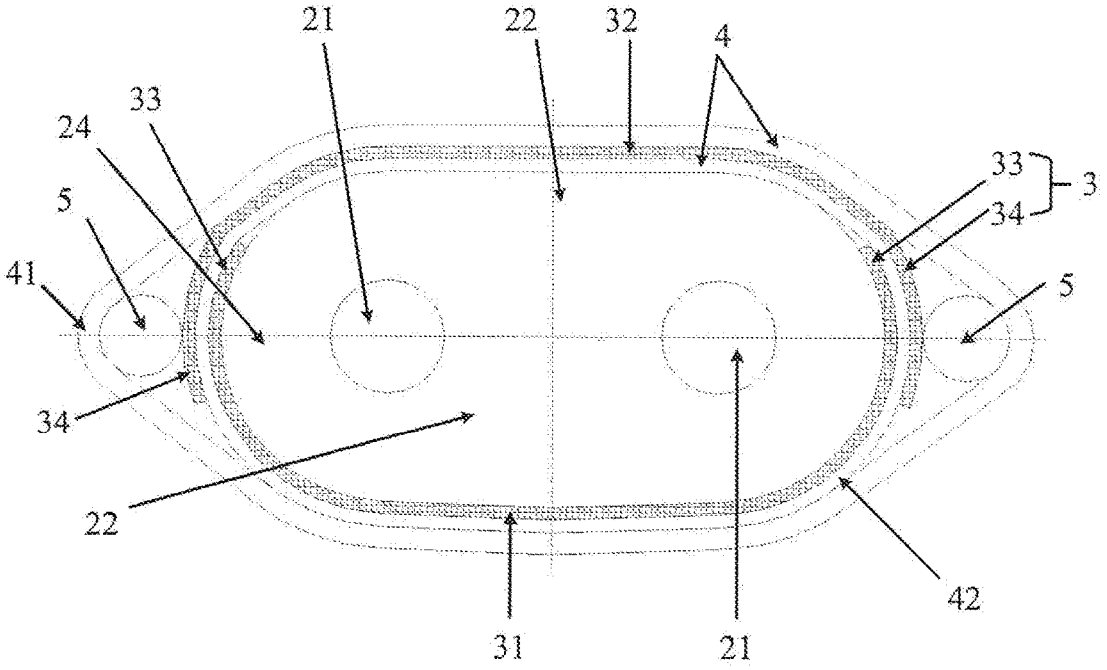
FIG. 4 is a cross-sectional view of a signal transmission cable of a fourth embodiment of the present disclosure.

In a fourth embodiment of the present disclosure, with reference to FIG. 4, the signal transmission cable of the fourth embodiment includes a group of wires 24, several insulation films 4, several metal shielding films 3 and several ground wires 5. The group of wires 24 includes several conductors 21 and an insulation layer 22. The conductors 21 are parallel to each other and are used for transmitting a group of differential electronic signals. These conductors 21 are made of metal material and each has an elongated cylindrical structure, or the conductors 21 each is a wire twisted by metal thin wires. The insulation layer 22 integrally encloses the conductors 21 in the interior. Two opposing surfaces of the insulation layer 22 are parallel to each other, while other two opposing surfaces are arcuate structures symmetrical to each other. The group of wires 24 corresponds to an arrangement of a pair of signal wires. The metal shielding films 3 include a first metal shielding film 31 and a second metal shielding film 32. The first metal shielding film 31 is coated on a part of the surface of the insulation layer 22, and the first metal shielding film 31 has first edges 33 each extending to a respective one of the two opposite arcuate surfaces of the insulation layer 22. There is a gap between the first edges 33 exposing a part of the surface of the insulation layer. The insulation films 4 include a first insulation film 41 and a second insulation film 42. The second insulation film 42 is coated on the first metal shielding film 31 and the insulation layer 22 exposed between the first edges 33. The first metal shielding film 31 is sandwiched between the second insulation film 42 and the insulation layer 22. The second metal shielding film 32 is coated on a part of the surface of the group of wires 24. The second edge 34 of the second metal shielding film 32 and the first edge 33 of the first metal shielding film 31 overlap each other with second insulation film 42 disposed between the first metal shielding film 31 and the second metal shielding film 32. The second metal shielding film 32 is coated on the insulation layer 22 exposed between the first edges 33 through the second insulation film 42, such that the group of wires 24 are completely coated by the first metal shielding film 31 and the second metal shielding film 32 so as to achieve a better electromagnetic shielding effect. The first insulation film 41 is coated on the second metal shielding film 32 and the surface of the second insulation film 42 exposed between the second edges 34, such that the second metal shielding film 32 is fixed between the first insulation film 41 and the second insulation film 42. The second metal shielding film 32 has a better fixing effect by means of the clamping of the first insulation film 41. These ground wires 5 are elongated cylindrical wires made from metal material, or the twisted wires. The ground wires 5 are arranged between the first insulation film 41 and the second metal shielding film 32 respectively. The axes of the ground wires 5 and the axes of the conductors 21 are aligned in a line, and the ground wires 5 are arranged at two opposite outer sides of the group of wires 24. The ground wires 5 are in physical contact with the second metal shielding film 32, such that the second metal shielding film 32 is electrically connected to the ground wires 5, thereby achieving a better shielding effect and enabling the group of wires 24 to have a better electrical characteristic. In addition, the insulation layer 22 of the group of wires 24 have a continuous planar surface, such that the metal shielding films 3 and the insulation films 4 can be coated on one another on the surface of the group of wires 24, thereby reducing the occurrence of warping and bending of these metal shielding films 3 and the insulation films 4.

Figure 5:
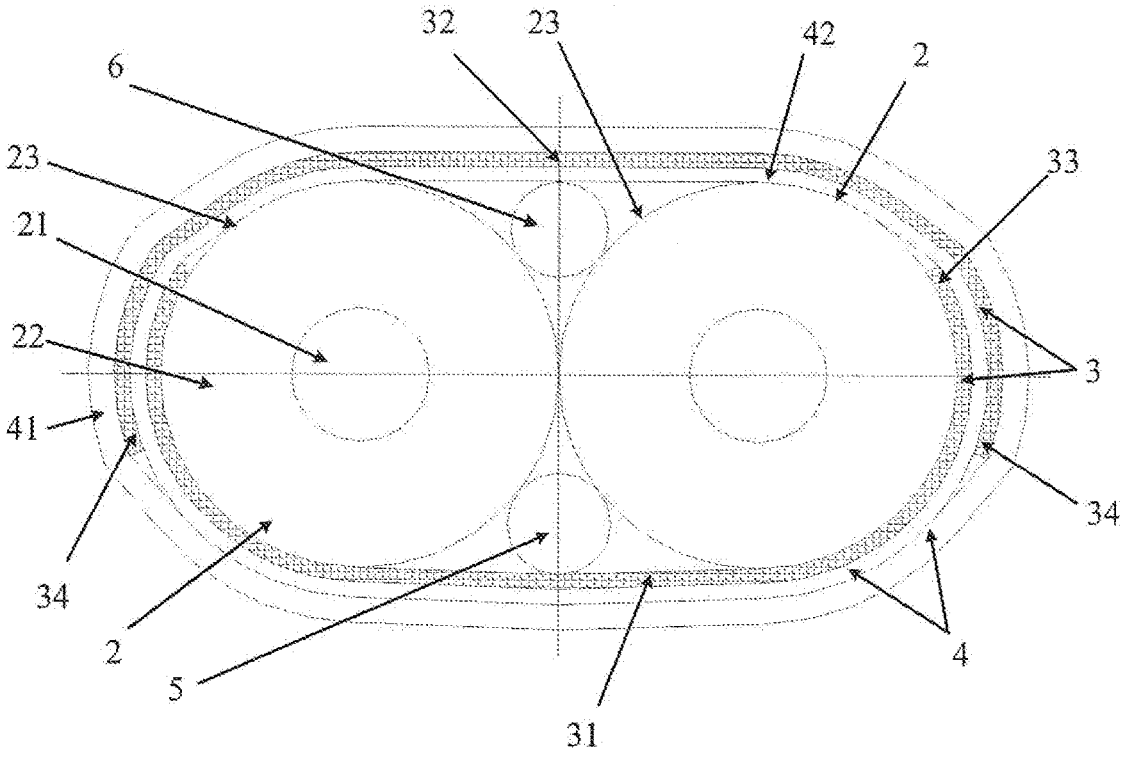
FIG. 5 is a cross-sectional view of a signal transmission cable of a fifth embodiment of the present disclosure.

In a fifth embodiment of the present disclosure, with reference to FIG. 5, the fifth embodiment is generally the same as the first embodiment in structure. The most important difference between the fifth embodiment and the first embodiment lies in that signal transmission cable of the fifth embodiment is further provided with fillers 6. The fillers 6 are arranged between the second insulation film 42 and the pair of signal wires 23. The fillers 6 are arranged to be symmetrical to the ground wire 5. The gaps between the pair of signal wires 23 are supported by the fillers 6 and the ground wire 5, thereby preventing the metal shielding films 3 and the insulation films 4 from being sank to the space between the pair of signal wires 23 which causing waste of material and unaesthetic appearance. Therefore, the surfaces of the insulation films 4 get planar. In addition, the fillers 6 can mitigate the friction between the pair of signal wires 23 and enable the overall structure of the signal transmission cable 1 to have a bending-resistant effect. The material of the fillers may be high molecular polymer such as polyethylene (PE), polyvinyl chloride (PVC), polypropylene (PP), fluorinated polymer or other thermoplastic material.

Figure 6:
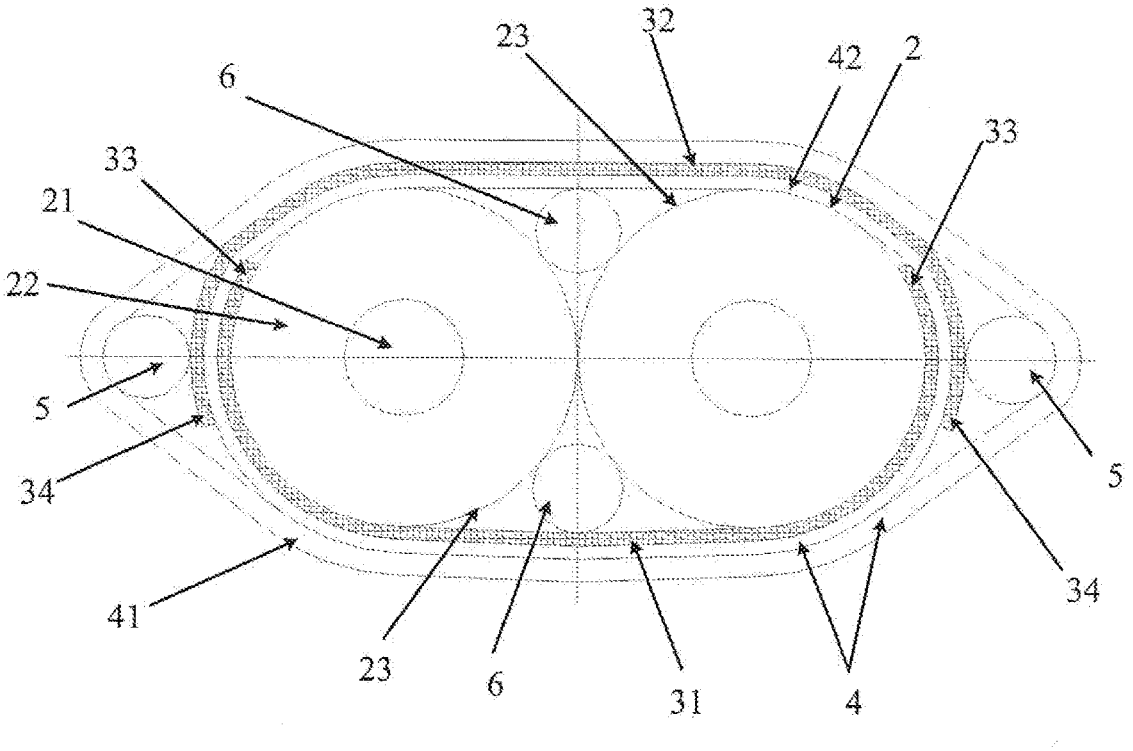
FIG. 6 is a cross-sectional view of a signal transmission cable of a sixth embodiment of the present disclosure.

In a sixth embodiment of the present disclosure, with reference to FIG. 6, the most important difference between the sixth embodiment and the fourth embodiment lies in that the integrally formed insulation layer 22 in the fourth embodiment is replaced by the insulation layers which are formed separately and a pair of fillers 6 in the sixth embodiment. In the sixth embodiment, each of the two conductors 21 is coated or warped with the insulation layer 22 in a coaxial manner so as to form at least one pair of signal wires 23, so there are recessed gaps between the pair of adjacent signal wires 23. These gaps may cause the metal shielding films 3 and insulation films 4 with which the outer surface of the pair of signal wires 23 is coated to be sank, likely causing the outer surface of the insulation films 4 to be uneven and causing the overall structure and shape unforeseeable. In order to prevent such case, the pair of fillers 6 which are specifically designed are symmetrically arranged in the gaps between the pair of signal wires 23. These fillers 6 support the metal shielding films 3 and the insulation films 4, such that the outer surface of the insulation films 4 tends to be smooth. In addition, the fillers 6 can also mitigate the friction between the pair of signal wires 23 and enable the overall structure of the signal transmission cable 1 to have a bending-resistant effect. The material of the fillers may be high molecular polymer such as polyethylene (PE), polyvinyl chloride (PVC), polypropylene (PP), fluorinated polymer or other thermoplastic material.

Figure 7:
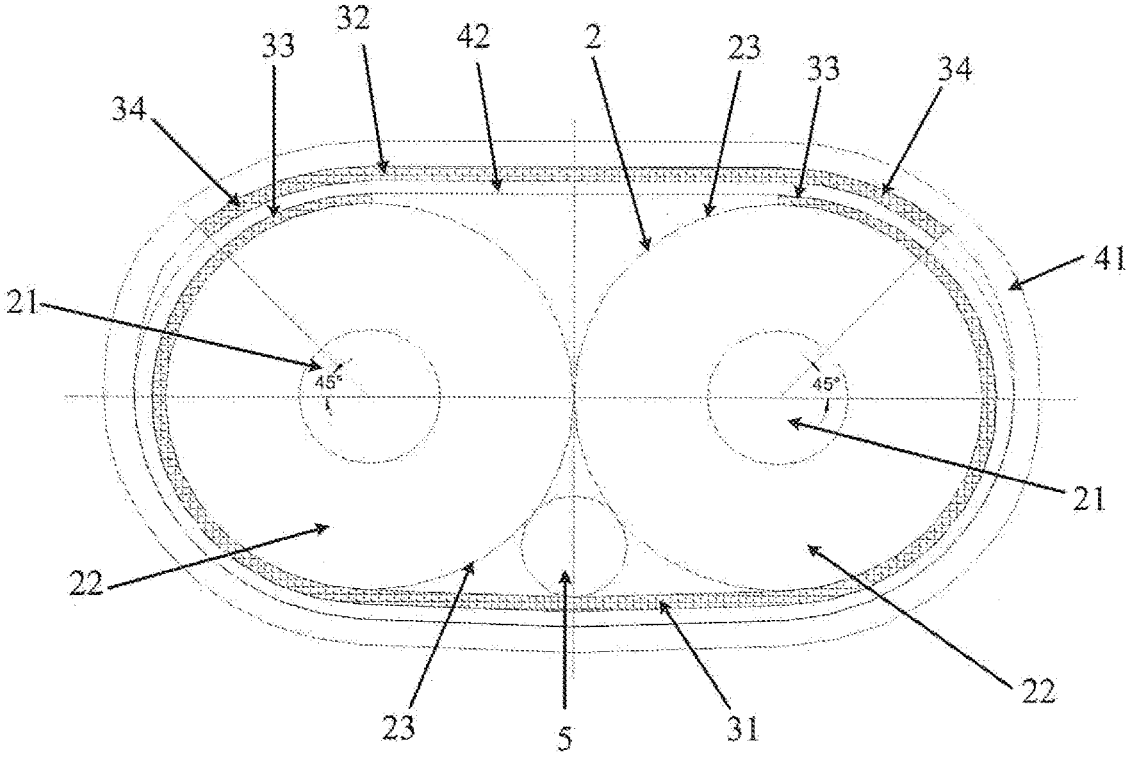
FIG. 7 is a cross-sectional view of a signal transmission cable of a seventh embodiment of the present disclosure.

In a seventh embodiment of the present disclosure, with reference to FIG. 7, the difference between the seventh embodiment and the first embodiment lies on the different positions and lengths in the design of the metal shielding films 3. In the seventh embodiment, the horizontal axis line is formed by connecting axes of the pair of signal wires 23, and perpendicular axis lines each passing through the axes of the pair of signal wires 23 are perpendicular to the horizontal axis line. An angle between the horizontal axis line and a line, which connects a terminal of each first edge 33 of the first metal shielding film 31 to the axis the signal wire 23 adjacent to the each first edge 33 is about 90 degrees. The metal shielding film 31 covers most of the surface area of the insulation layers 22 of the pair of signal wires 23. The first edges 33 are separated by a distance which is about the diameter of one signal wire 23. The second insulation film 42 covers the first metal shielding film 31 and the gap formed between the first edges 33. The second metal shielding film 32 covers the second insulation film 42. The second metal shielding film 32 overlaps each first edge 33 of the first metal shielding film 31 with the second insulation film 42 disposed between the first metal shielding film 31 and the second metal shielding film 32, and covers the gap between the first edges 33. An angle between the horizontal axis line and a line, which connects the terminal of the second edge 34 of the second metal shielding film 32 to the axis of the signal wire 23 adjacent to the second edge 34, is about 45 degrees, and an angle between the perpendicular axis lines and a line, which connects the terminal of the second edge 34 of the second metal shielding film 32 to the axis of the signal wire 23 to the second edge 34, is about 45 degrees. The first insulation film 41 covers the surface of the second metal shielding film 32 and the surface of the second insulation film 42, and the first metal shielding film 31 partially overlaps the second metal shielding film 32, such that the pair of signal wires 23 are completely coated, and hence the pair of signal wires 23 have a better electromagnetic shielding effect.

Figure 8:
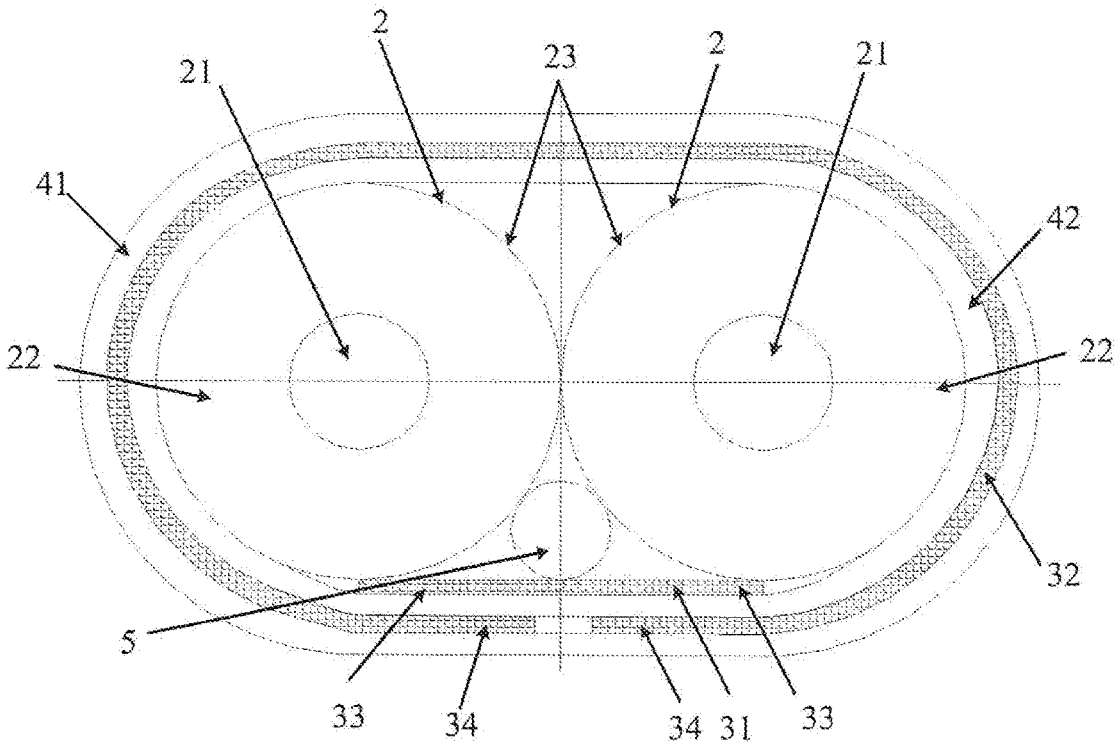
FIG. 8 is a cross-sectional view of a signal transmission cable of a eighth embodiment of the present disclosure.
Figure 9:
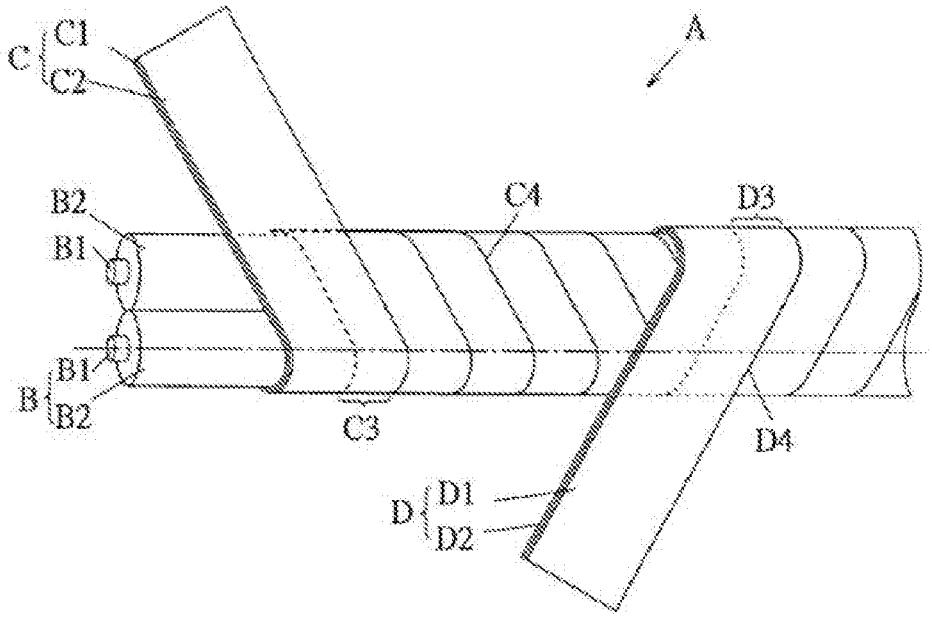
FIG. 9 is a diagram showing of an existing art of U.S. Pat. No. 8,653,373.

In an eighth embodiment of the present disclosure, with reference to FIG. 8, the difference between the eighth embodiment and the first embodiment lies on the different positions and lengths in the design of the metal shielding films 3. In the eighth embodiment, the first metal shielding film 31 serves as a tangent plane, which is tangential to the surface of each insulating layers 22 of the pair of signal wires 23. The terminal of each first edge 33 of the first metal shielding film 31 is tangential to the surface of the respective insulation layer 22 to form a tangency point position. The first metal shielding film 31 is parallel to the horizontal axis line passing through the axes of the pair of signal wires 23. The length of the first metal shielding film 31 is approximately equal to the diameter of one signal wire 23. The second insulation film 42 is coated on each insulation layer 22 of the pair of signal wires 23 and the first metal shielding film 31, and the first metal shielding film 31 is fixed to the surface of each insulation layer 22 by the second insulation film 42. The second metal shielding film 32 is coated on the surface of the second insulation film 42. The second edges 34 of the second metal shielding film 32 overlap the first edges 31 at two ends of the first metal shielding film 31 via the second insulation film 42. The second edges 34 of the second metal shielding film 32 are adjacent and separated by a gap. The length of the gap between the second edges 34 is less than the length of the first metal shielding film 31. The first insulation film 41 encloses the second metal shielding film 32 and the gap between the second edges 34. The ground wire 5 is arranged in a space enclosed by the pair of signal wires 23 and the first metal shielding film 31, and is in contact with the first metal shielding film 31 and the pair of signal wires 23 to provide a better support for the first metal shielding film 31. The ground wire 5 is in contact with the first metal shielding film 31 and is electrically connected to the first metal shielding film 31, such that the first metal shielding film 31 has a better grounding effect. Through the arrangement in which the first edges of the first metal shielding film 31 overlap the second edges of the second metal shielding film 32, the pair of signal wires 23 are completely enclosed in the space formed by the first metal shielding film 31 and the second metal shielding film 32, such that the metal shielding films 3 can shield the electromagnetic interference for the pair of signal wires 23 and provide a better electromagnetic shielding effect.

In the related art, the metal shielding films are usually designed to be longitudinally spirally wound. However, the metal shielding films may have overlapping or gaps during the longitudinal winding process. Since the overlapping area actually has deviations, or the overlapping area is likely changed after the cable is bent, the wires have unpredictable impedance variations. Compared with the related art, these wires in the embodiments of the present disclosure are oppositely coated by the metal shielding films made from metal thin sheets, which greatly alleviates the problem that the longitudinal thickness of the wire is not uniform due to the overlapping of the metal shielding films. Moreover, in combination with the design of insulation films, the metal shielding films are fixed to the outer surface of the wires so as to reduce the interference noise on the wires from the outside or from the space between the wires and to achieve a better electromagnetic shielding effect.

The above descriptions are merely embodiments of the present disclosure, and are not intended to limit the scope of the present disclosure. Therefore, any simple equivalent change and modification according to the scope of disclosure and contents of the specification of the present disclosure should still be within the scope of the present disclosure.

Although the embodiments of the present disclosure have been disclosed for illustrative purposes, those skilled in the art will note that various changes, modifications and substitutions may be made without departing from the spirit and scope disclosed in the appended claims.

What is claimed is:

1. A signal transmission cable, comprising:

a pair of signal wires, which is used for transmitting a group of differential electronic signals;

a first metal shielding film, which is coated on a first part of a surface of the pair of signal wires;

a second metal shielding film, which is opposite to the first metal shielding film and is coated on a second part of the surface of the pair of signal wires; and a first insulation film, which is used for securing the first metal shielding film and the second metal shielding film to the surface of the pair of signal wires, wherein the first metal shielding film and the second metal shielding film collectively are coated on the entire surface of the pair of signal wires, and the second metal shielding film partially overlaps the first metal shielding film on a periphery of the pair of signal wires, wherein two ends of the first metal shielding film each have a first edge, two ends of the second metal shielding film each have a second edge, a horizontal axis line connects axes of the pair of signal wires, two perpendicular axis lines pass through the respective axes of the pair of signal wires and are perpendicular to the horizontal axis line, an angle between each of the horizontal axis line and the perpendicular axis lines and a line connecting a terminal of the first edge to the axis of one of the pair of signal wires adjacent to the first edge is approximately 45 degrees, and an angle between each of the horizontal axis line and the perpendicular axis line and a line connecting a terminal of the second edge to the axis of one of the pair of signal wires adjacent to the second edge is approximately 45 degrees.

2. The signal transmission cable according to claim 1, further comprising at least one ground wire arranged between the first insulation film and the pair of signal wires.

3. The signal transmission cable according to claim 1, further comprising a second insulation film sandwiched between the first metal shielding film and the second metal shielding film, wherein the second insulation film is coated on the pair of signal wires.

4. The signal transmission cable according to claim 3, further comprising two ground wires formed inside the second insulation film, wherein the two ground wires are arranged in gaps adjacent to the pair of signal wires.

5. The signal transmission cable according to claim 3, wherein each of the first insulation layer and the second insulation layer is made of a transparent or translucent material.

6. The signal transmission cable according to claim 1, further comprising two ground wires sandwiched between the first insulation film and the second metal shielding film, wherein the two ground wires and the axes of the pair of signal wires are aligned in a line.

7. The signal transmission cable according to claim 1, wherein the first metal shielding film and the second metal shielding film are coated on the pair of signal wires in a manner of being longitudinally arranged in an extension direction of the pair of signal wires and facing each other.

8. The signal transmission cable according to claim 1, wherein each of the first metal shielding film and the second metal shielding film is a laminate film made from Aluminium and Polyester.

9. The signal transmission cable according to claim 1, wherein at least one ground wire is sandwiched between the pair of signal wires and the first metal shielding film.

10. A signal transmission cable, comprising:

a pair of signal wires, which is used for transmitting a group of differential electronic signals;

a first metal shielding film, which is coated on a first part of a surface of the pair of signal wires;

a second metal shielding film, which is opposite to the first metal shielding film and is coated on a second part of the surface of the pair of signal wires;

wherein the first metal shielding film and the second metal shielding film collectively are coated on the entire surface of the pair of signal wires, and the second metal shielding film partially overlaps the first metal shielding film on a periphery of the pair of signal wires, wherein each of the first metal shielding film and the second metal shielding film is one of a group consisting of: one or more layers of plastic tape spirally wound to the exterior of the pair of signal wires, and one or more layers of plastic extruded and secured to the exterior of the pair of signal wires, a first insulation film, which is used for securing the first metal shielding film and the second metal shielding film to the surface of the pair of signal wires; and a second insulation film sandwiched between the first metal shielding film and the second metal shielding film, wherein the second insulation film is coated on the pair of signal wires.

11. A signal transmission cable, comprising:

a pair of signal wires disposed closed to each other;

a first metal shielding film surrounding a first exterior of the pair of signal wires;

a second metal shielding film surrounding a second exterior of the pair of signal wires; and a first insulation film surrounding the first metal shielding film and the second metal shielding film;

wherein the first metal shielding film and the second metal shielding film are combined to cover an entire of the pair of signal wires, in a direction of the diameter of the signal wires, two ends of the first metal shielding film overlap the second metal shielding film except other part of its own on a periphery of the pair of signal wires, wherein two ends of the first metal shielding film each have a first edge, two ends of the second metal shielding film each have a second edge, a horizontal axis line connects axes of the pair of signal wires, two perpendicular axis lines passes through the respective axes of the pair of signal wires and are perpendicular to the horizontal axis line, an angle between each of the horizontal axis line and the perpendicular axis lines and a line connecting a terminal of the first edge to the axis of one of the pair of signal wires adjacent to the first edge is approximately 45 degrees, and an angle between each of the horizontal axis line and the perpendicular axis line and a line connecting a terminal of the second edge to the axis of one of the pair of signal wires adjacent to the second edge is approximately 45 degrees.

12. The signal transmission cable according to claim 11, wherein further comprising a second insulation film sandwiched between the first metal shielding film and the second metal shielding film, the second insulation film securing the first metal shielding film to an outer surface of the pair of the signal wires, the second insulation film surrounds the entirety of the pair of the signal wires.

13. The signal transmission cable according to claim 12, further comprising at least one ground wire sandwiched the pair of the signal wires and one of the first metal shielding film and the second insulation film.

14. The signal transmission cable according to claim 11, wherein at least one of the first metal shielding film and the second metal shielding film serves as a tangent plane.

15. The signal transmission cable according to claim 11, further comprising at least one ground wire sandwiched between the first insulation film and one of the first and the second metal shielding films.

16. The signal transmission cable according to claim 11, further comprising at least one ground wire sandwiched between the first and the second metal shielding films.

* * * * *